US006571565B2

(12) United States Patent
Herrick et al.

(10) Patent No.: US 6,571,565 B2
(45) Date of Patent: Jun. 3, 2003

(54) EVACUATION VOLUME FOR A REFRIGERATION SYSTEM

(75) Inventors: Todd W. Herrick, Tecumseh, MI (US); Rick L. Bunch, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 29 days.

(21) Appl. No.: 09/850,262

(22) Filed: May 7, 2001

(65) Prior Publication Data

US 2002/0162343 A1 Nov. 7, 2002

(51) Int. Cl.[7] ..... F25B 41/00; F25B 45/00
(52) U.S. Cl. ..... 62/77; 62/174
(58) Field of Search ..... 62/174, 149, 77

(56) References Cited

U.S. PATENT DOCUMENTS

| | | | | |
|---|---|---|---|---|
| 1,594,422 A | | 8/1926 | Marshall | |
| 4,644,755 A | | 2/1987 | Esslinger et al. | 62/126 |
| 5,226,471 A | | 7/1993 | Stefani | 165/13 |
| 5,359,863 A | * | 11/1994 | Lewis | 62/174 |
| 5,379,604 A | | 1/1995 | Furr | 62/77 |
| 5,408,840 A | | 4/1995 | Talley | 62/126 |
| 5,481,883 A | | 1/1996 | Harkness, Jr. et al. | 62/77 |
| 5,501,577 A | | 3/1996 | Cornell et al. | 417/9 |
| 5,542,261 A | | 8/1996 | Albertson et al. | 62/174 |
| 5,564,280 A | | 10/1996 | Schilling et al. | 62/84 |
| 5,761,261 A | | 6/1998 | Karrh et al. | 376/283 |
| 5,875,638 A | | 3/1999 | Tinsler | 62/149 |
| 6,016,661 A | * | 1/2000 | Sagar | 62/149 |

* cited by examiner

*Primary Examiner*—William Wayner
(74) *Attorney, Agent, or Firm*—Baker & Daniels

(57) ABSTRACT

A refrigeration system including a pair of heat exchangers, a hermetic compressor assembly having a compressor housing containing refrigerant fluid, fluid conveying lines and a flow restriction device forming a working refrigerant system, an evacuation volume having one of a first, substantially evacuated state and a second, fluid-containing state, a control valve located between the working refrigeration system and the evacuation volume and having an initial, closed position and an open position, and at least one refrigerant gas detector located externally of the working refrigeration system and in communication with the control valve. The evacuation volume is fluidly isolated from the working refrigeration system in the valve closed position and in fluid communication with the working refrigeration system in the valve open position. The valve is opened in response to refrigerant gas being detected by the detector, and refrigerant fluid in the working refrigeration system is sucked into the evacuation volume with the evacuation volume undergoing a change from its first to its second state and the valve resuming its said closed position when the evacuation volume is in the second state.

31 Claims, 7 Drawing Sheets

EVACUATION VOLUME FOR A REFRIGERATION SYSTEM

BACKGROUND OF THE INVENTION

1. Field of Invention

The present invention relates to refrigerant systems and hermetic compressors therefor, and in particular to the prevention of the complete loss of the refrigerant gas charge therein, to the ambient environment consequent to a refrigerant leak.

2. Description of the Related Art

Although it is well-known that a refrigerant system leak can develop, for example, at the compressor's terminal assembly, or the seals between components, very few prior art compressors or refrigeration systems include a means for retaining the refrigerant gas should a leak occur. Rather, past approaches have focused primarily on attempting to prevent or minimize the likelihood of a leak. Prior attempts at retaining leaked refrigerant gas include the use of a recovery line and tank attached to a pressure relief valve (U.S. Pat. No. 5,408,840), a trap and diversion valve system (U.S. Pat. No. 5,564,280), or the use of rupture disks in communication with containment vessels (U.S. Pat. No. 5,379,604, U.S. Pat. No. 5,542,261, U.S. Pat. No. 5,761,261); the leak must occur through these devices for the leaked gas to be captured.

Recent regulations have forced a change from the chlorofluorocarbon (CFC) refrigerants, such as Freon®, to hydrofluorocarbon (HFC) refrigerants that result in less ozone layer depletion in the event of a leak, thereby reducing potential damage to the environment. However, the HFC's are still potentially harmful and should still be prevented from entering the atmosphere. Thus, if there is a system leak, retention of at least a portion of the leaking refrigerant gas, whether CFC or HFC, is necessary to best protect the environment.

An additional concern with leaking refrigerant is the cost of replacing same. Refrigerant is an expensive component of a refrigeration system; the cost of replacing even a portion of the system's refrigerant can be considerable. Therefore, where at least a portion of the system's refrigerant could be retained for reprocessing or reuse, rather than lost to the atmosphere, would be desirable.

A means for retaining at least a portion of the refrigerant which would otherwise leak from a refrigeration system, and allows the retained refrigerant to be recovered for later use, is therefore desirable.

SUMMARY OF THE INVENTION

The present invention provides a refrigeration system including a pair of heat exchangers, a hermetic compressor assembly having a compressor housing containing refrigerant fluid, fluid conveying lines and a flow restriction device forming a working refrigerant system, an evacuation volume having one of a first, substantially evacuated state and a second, fluid-containing state, a control valve located between the working refrigeration system and the evacuation volume and having an initial, closed position and an open position, and at least one refrigerant gas detector located externally of the working refrigeration system and in communication with the control valve. The evacuation volume is fluidly isolated from the working refrigeration system in the valve closed position and in fluid communication with the working refrigeration system in the valve open position.

The valve is opened in response to refrigerant gas being detected by the detector, and refrigerant fluid in the working refrigeration system is sucked into the evacuation volume with the evacuation volume undergoing a change from its first to its second state and the valve resuming its said closed position when the evacuation volume is in the second state.

The present invention further provides a refrigeration system including a working refrigeration system including a hermetic compressor assembly having a compressor housing containing refrigerant fluid, a pair of heat exchangers, a flow restriction device, and fluid conveying lines, an evacuation volume located externally of the compressor housing and having one of a first, substantially evacuated state and a second, fluid-containing state, a control valve located between the working refrigeration system and the evacuation volume and having an open position and a closed position, and means for detecting a refrigerant leak external the working refrigeration system. The evacuation volume is fluidly isolated from the working refrigeration system in the valve closed position and in fluid communication with the working refrigeration system in the valve open position. The valve is opened in response to detection of a refrigerant leak and is subsequently closed to maintain the evacuation volume in its second state and fluidly isolated from the rest of the working refrigeration system.

The present invention provides a method of retaining at least a portion of refrigerant fluid of a refrigeration system in the event of a refrigeration leak therefrom, including detecting a refrigerant leak from the system, opening a valve located between the refrigeration system and an initially empty evacuation chamber in response to detection of the leak, receiving at least a portion of the refrigerant fluid in the system through the open valve and into the evacuation chamber, and closing the valve after the evacuation chamber has received refrigerant fluid from the system. Refrigerant which enters the evacuation volume may be received from, for example, the compressor housing.

The present invention also provides a hermetic compressor assembly including a compressor housing containing refrigerant fluid, a compressor mechanism located in the housing, a motor assembly located in the housing and operatively coupled to the compressor mechanism, an evacuation volume attached to and located externally of the compressor housing and having one of a first, substantially evacuated state and a second, fluid-containing state, a control valve located between said compressor housing and said evacuation volume and having an open position and a closed position, and at least one refrigerant gas detector located externally of said compressor housing and in communication with said control valve. The evacuation volume is fluidly isolated from the compressor housing in the valve closed position and in fluid communication with the compressor housing in the valve open position. The valve is opened in response to refrigerant gas being detected by the detector, whereby refrigerant fluid in the compressor housing is sucked into the evacuation volume and the evacuation volume undergoes a change from its first to its second state with the valve being in its closed position when the evacuation volume is in its second state.

An advantage of the inventive evacuation volume is that a portion of the refrigerant gas leaking from the system is sealably retained in a chamber so that that portion of gas does not escape to the ambient environment. The captured refrigerant may subsequently be recovered from the chamber for reuse.

BRIEF DESCRIPTION OF THE DRAWINGS

The above-mentioned and other features and objects of this invention, and the manner of attaining them, will become more apparent and the invention itself will be better understood by reference to the following description of the embodiment of the invention taken in conjunction with the accompanying drawings, wherein.

Corresponding reference characters indicate corresponding parts throughout the several views. The exemplification set out herein illustrates embodiments of the invention, and such exemplification is not to be construed as limiting the scope of the invention in any manner.

DETAILED DESCRIPTION OF THE INVENTION

Figure 1:
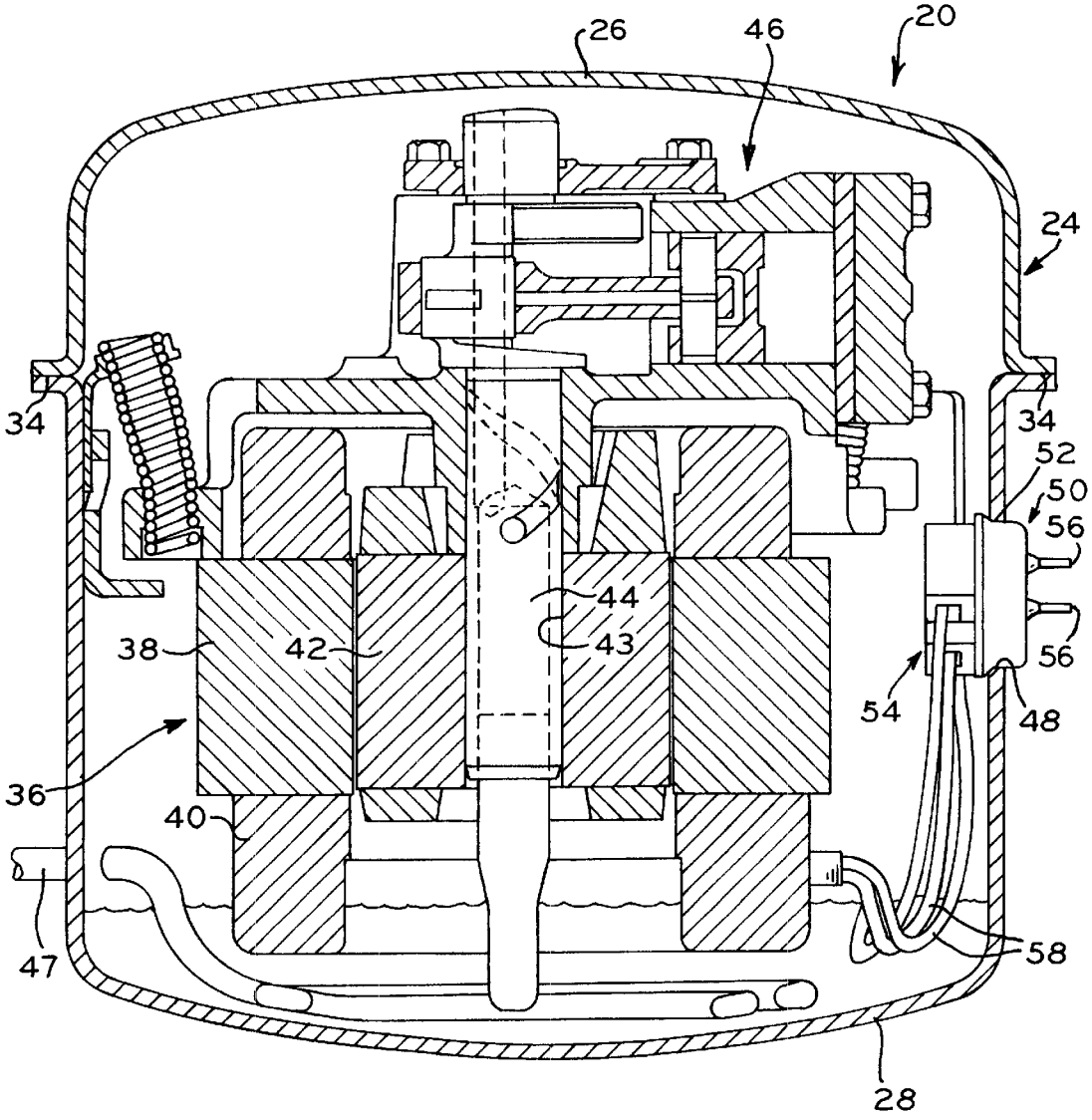
FIG. 1 (PRIOR ART)
FIG. 1 is a longitudinal sectional view of a prior art vertical reciprocating compressor to which the inventive refrigerant-capturing chamber may be attached.

For the purposes of promoting an understanding of the principles of the invention, reference will now be made to the embodiments illustrated in the drawings and specific language will be used to describe the same. It will nevertheless be understood that no limitation of the scope of the invention is thereby intended.

Figure 2:
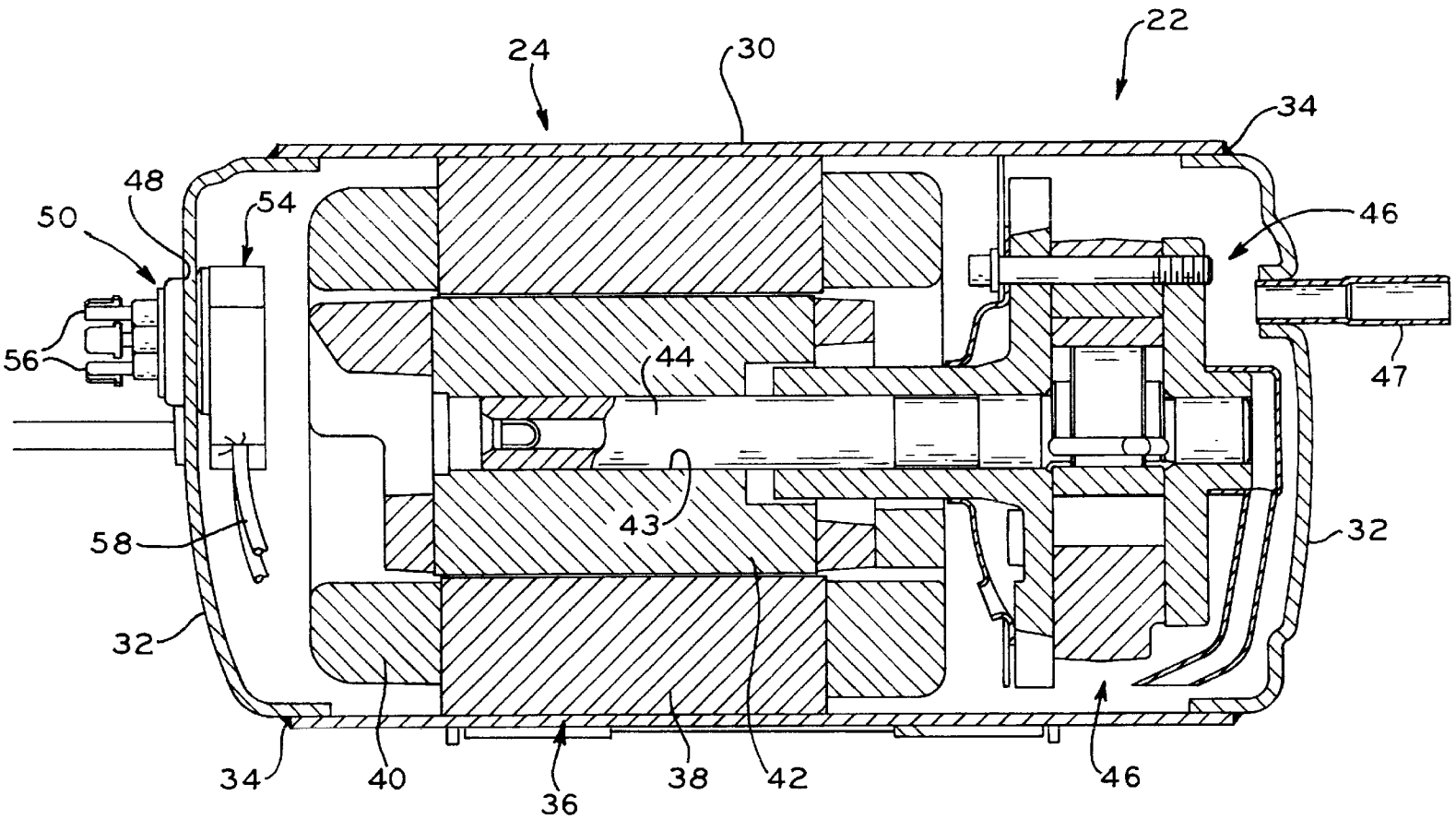
FIG. 2 (PRIOR ART)
FIG. 2 is a longitudinal sectional view of a prior art horizontal rotary compressor to which the inventive refrigerant-capturing chamber may be attached.

Referring to FIGS. 1 and 2, reciprocating compressor assembly 20 and rotary compressor assembly 22 are shown as examples of types of hermetic compressor assemblies in which the present invention may be advantageously used. Other hermetic compressor types, such as, for example, a scroll compressor assembly, may also benefit from use of the present invention.

Figure 3:
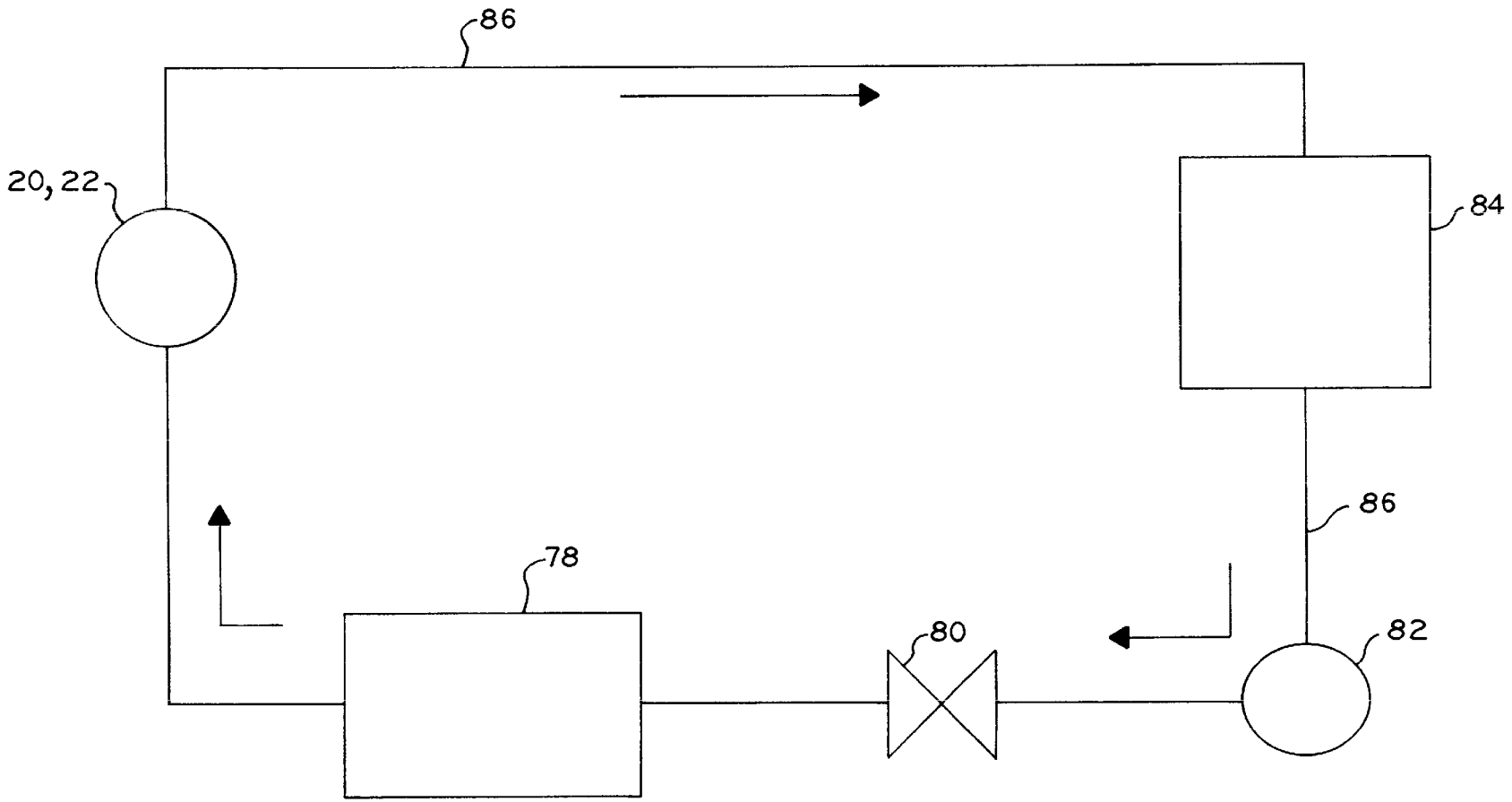
FIG. 3 is a schematic view of a working refrigeration system into which the inventive refrigerant-capturing chamber may be incorporated.

The compressor assembly, which may be part of a working refrigeration system (FIG. 3) also comprising receiver 82, condenser 84, expansion device 80, evaporator 78 and refrigerant conveying lines 86, receives refrigerant substantially at suction pressure and discharges it substantially at discharge pressure. The compressor assembly may be of a "high side" type, in which the portion of the housing in which the motor is located is at discharge pressure, or of a "low side" type, in which the portion of the housing in which the motor is located is at suction pressure. The present invention may be beneficially employed in either a high side or a low side type.

Reciprocating compressor assembly 20 (FIG. 1) comprises housing 24 which includes upper housing portion 26 disposed atop lower housing portion 28. Reciprocating compressor assembly 20 is of the low side type, and in operation, refrigerant gas is drawn first into housing 24, and then into compression mechanism 46, the compressed gas then discharged directly from the compression mechanism and the housing via discharge tube or shock loop 47 and recirculated through the working refrigerant system.

Housing 24 of rotary compressor assembly 22 includes main housing portion 30 and two end portions 32 (FIG. 2). Rotary compressor assembly 22 is of the high side type, and in operation, refrigerant gas is drawn from outside its housing 24 directly into its compression mechanism 46 via a suction tube (not shown). Within compression mechanism 46, the gas is compressed to a higher, discharge pressure, and then discharged from the compression mechanism into its housing 24 substantially at discharge pressure. Thereafter, the compressed gas is exhausted from the housing through discharge tube 47 and recirculated through the working refrigerant system.

The housing portions for both compressor assemblies 20 and 22 are hermetically sealed at 34 by a method such as welding, brazing or the like. Hermetic compressor assemblies 20 and 22 each also include electric motor 36 disposed within housing 24. Motor 36 comprises stator 38 provided with windings 40, and rotor 42, which is surrounded by stator 38. Rotor 42 has central aperture 43 in which drive shaft or crankshaft 44 is secured by an interference fit.

The general structure and operation of a reciprocating compressor assembly is disclosed in U.S. Pat. No. 5,266,016, the complete disclosure of which is hereby expressly incorporated herein by reference. The general structure and operation of a rotary compressor assembly is disclosed in U.S. Pat. No. 5,222,885, the complete disclosure of which is hereby expressly incorporated herein by reference. The general structure and operation of a scroll compressor assembly is disclosed in U.S. Pat. No. 5,306,126, the complete disclosure of which is hereby expressly incorporated herein by reference. Each of these patents is assigned to Tecumseh Products Company.

Figure 4:
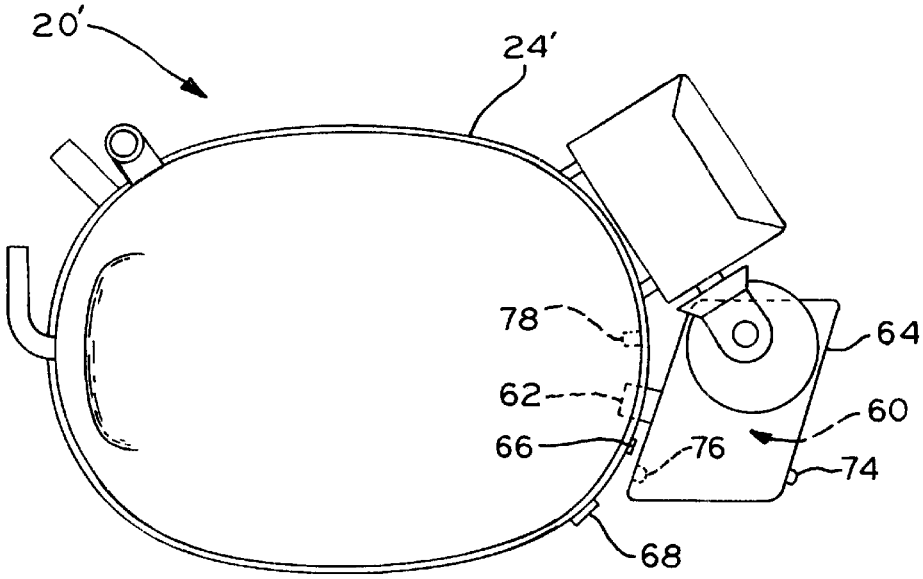
FIG. 4 is a top view of a reciprocating piston compressor in accordance with the present invention.
Figure 5:
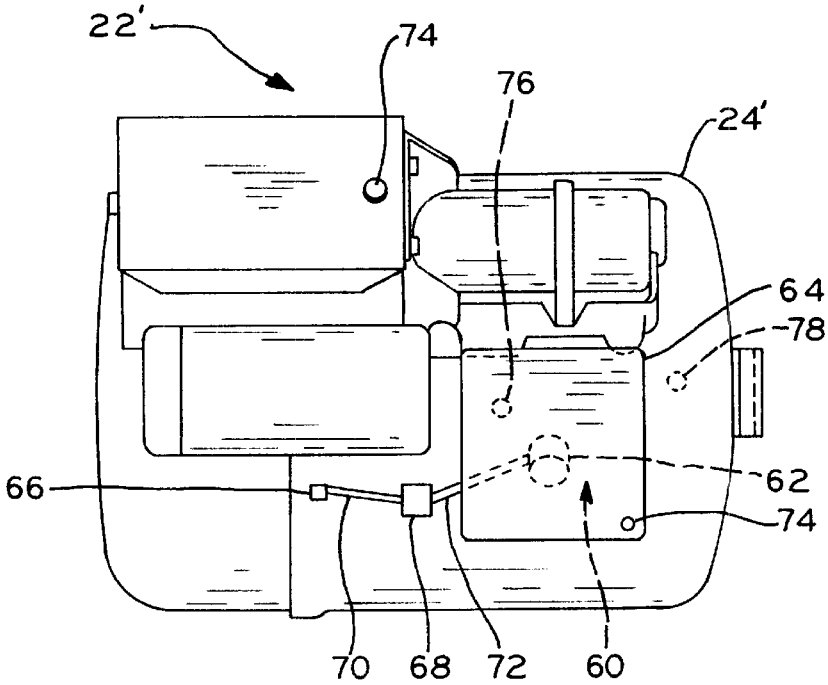
FIG. 5 is a side view of a horizontal rotary compressor in accordance with the present invention.
Figure 6:
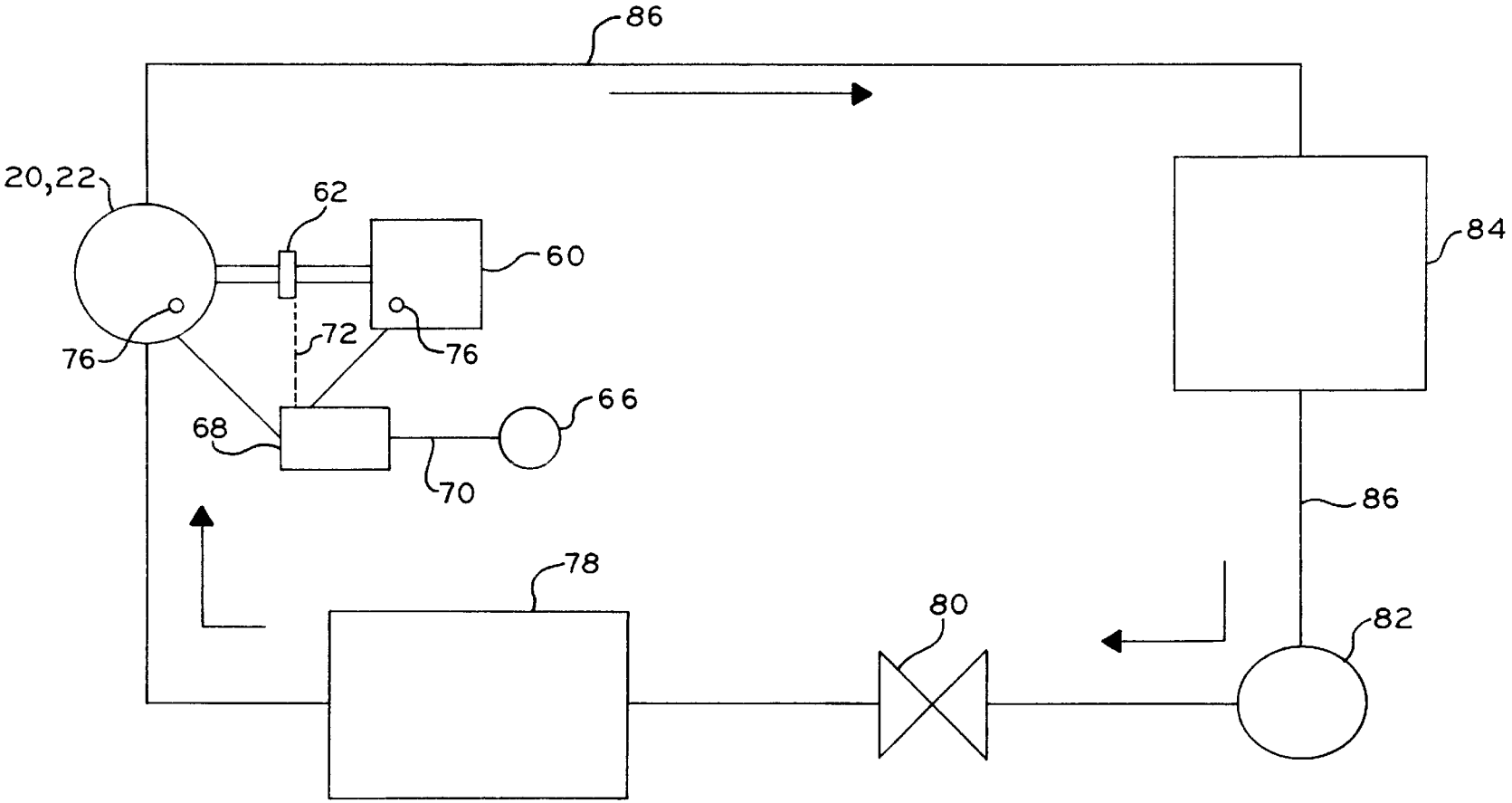
FIG. 6 is a schematic view of a refrigeration system in accordance with the present invention.

Referring now to FIGS. 4 and 5, in accordance with the present invention, reciprocating piston compressor 20' (FIG. 4) and horizontal rotary compressor 22' (FIG. 5) are shown to include chamber 64 in which is provided evacuation volume 60, at least one refrigerant gas detector 66, control or check valve 62 located between compressor housing 24' and chamber 64, and microcontroller 68. Evacuation volume 60 receives from the compressor housing a portion of the refrigerant gas that is leaking from the refrigeration system. As shown, single gas detector 66 is located on the exterior of housing 24' in a position where leaking refrigerant gas may be detected. It is notable that a plurality of detectors 66 may be used in conjunction with a unit controller which sends an electrical signal to microcontroller 68 and that detector 66 may be located near any potential refrigerant leak site, such as near terminal assembly 50, near any joints or fittings, or any other location of the working refrigerant system which may be vulnerable to refrigerant gas leaks. Gas detector 66 is in electrical communication with microcontroller 68 via wires 70 and provides a signal to microcontroller 68. Upon detection of leaked refrigerant, and in response to that signal, microcontroller 68 opens control valve 62 to allow entry of the refrigerant gas into volume 60, which is initially under vacuum. Microcontroller 68 is in communication with control valve 62 via wires 72 and may be of any conventional type usable for simple control operations. Detector 66 may be one of several known types of electric refrigerant detectors which generates an electrical signal in response to detecting a refrigerant gas. One example of such a detector is model GK-1010 manufactured by Neo Dym. It should be noted that inventive compressors 20', 22' may be incorporated into a refrigeration system, such as that shown in FIG. 6, which may include receiver 86, condenser 84, expansion device 80, evaporator 78, and refrigerant conveying lines 86 in addition to evacuation volume 60.

Figure 7:
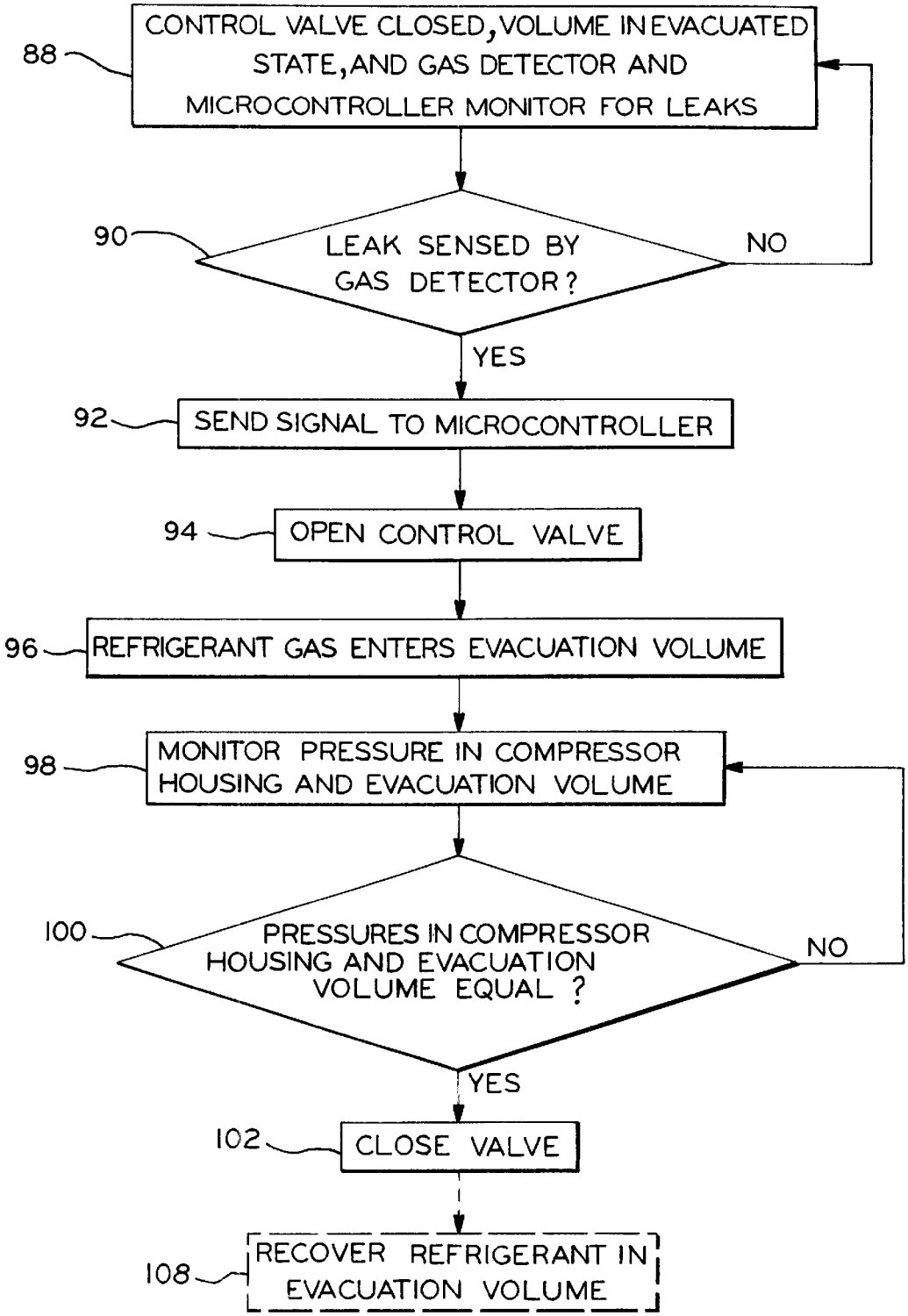
FIG. 7 is a flow diagram of a first embodiment of the evacuation procedure in accordance with the present invention.

In operation, volume 60 is fluidly isolated from compressor 20', 22' by solenoid control valve 62, such as the 8030 Series model manufactured by ASCO, which is normally maintained in a closed position, preventing any refrigerant gas from exiting compressor housing 24' and entering evacuated chamber 64. With reference to FIG. 7, during the time before control valve 62 is opened, volume 60 is maintained in a first, evacuated state and detector 66 and microcontroller 68 monitor for any refrigerant gas leaks (block 88). When detector 66 detects a leak of refrigerant gas (block 90), a signal is sent to microcontroller 68 (block 92) thereby, in response to receipt of this signal, valve 62 opens (block 94), thereby allowing a portion of refrigerant gas in the compressor housing to enter chamber 64 (block 96). The refrigerant gas within compressor housing 24' is, in essence, pulled into chamber 64 by the pressure differential between the interior of compressor housing 24 (at some positive pressure) and volume 60 (vacuum). Microcontroller 68 monitors the pressure differential between compressor housing 24 and volume 60 by comparing the signals provided by transducers 76 and 78 (block 98). Once the pressure in compressor 20', 22' and chamber 64 equalize (block 100), as determined by microcontroller 68, valve 62 is closed by microcontroller 68 (block 102), thereby isolating the refrigerant gas in chamber 64. If the pressure in compressor 20', 22' and chamber 64 have not equalized, microcontroller 68 continues monitoring for a pressure equalization. Alternatively, as shown in FIG. 8, valve 62 may be closed after a predetermined period of time (block 106), such as, for example 10 seconds, in response to a timer provided in microcontroller 68 (block 104).

Figure 8:
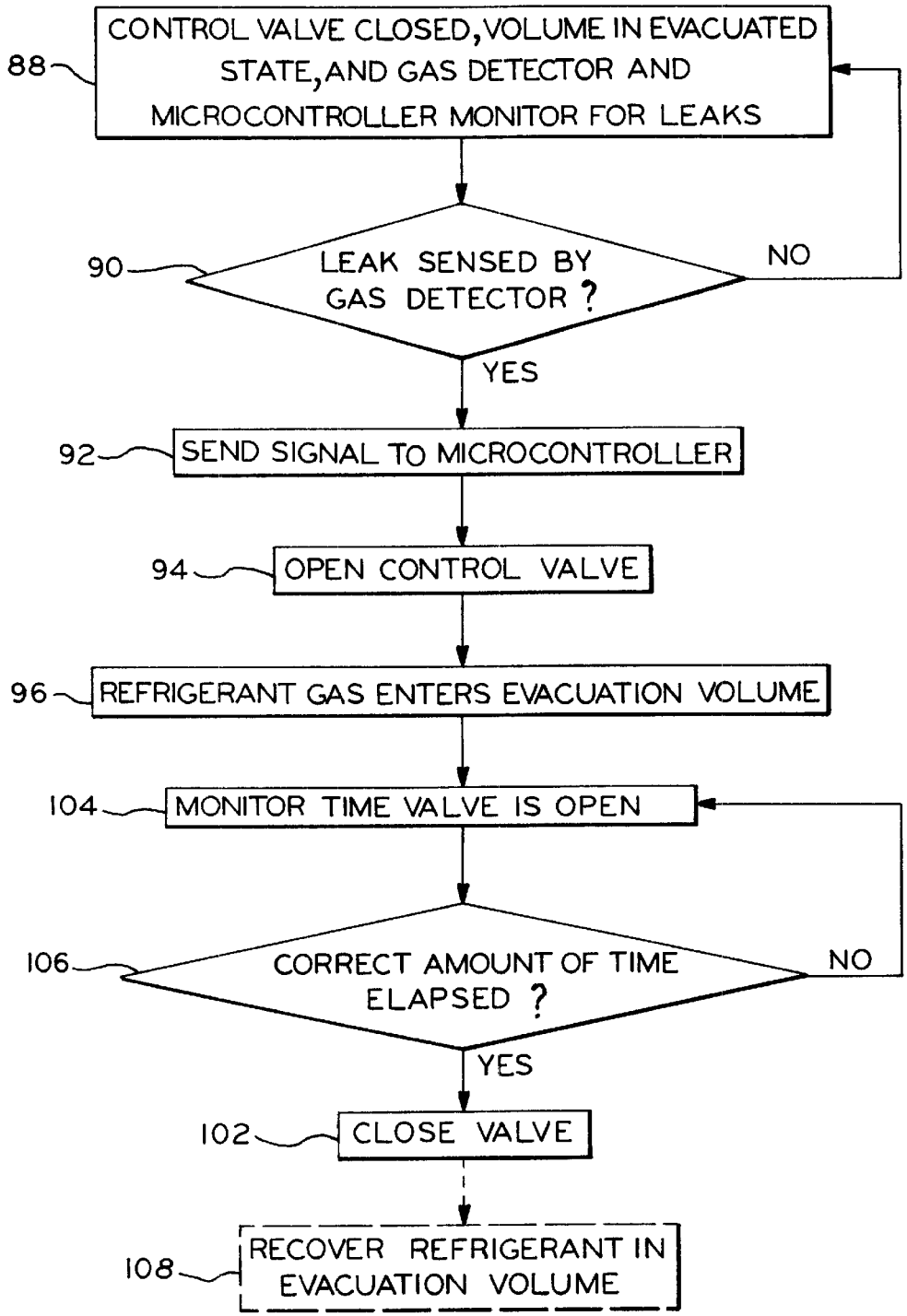
FIG. 8 is a flow diagram of a second embodiment of the evacuation procedure in accordance with the present invention.

Referring to FIGS. 7 and 8, once the refrigerant gas is isolated in chamber 64, it may be recovered through pressure valve 74 (block 108), which may be, for example, of the well-known type manufactured by Schrader-Bridgeport, provided on chamber 64. The recovery step is shown in dashed lines because recovery of the refrigerant gas is a separate step to be subsequently performed. A known refrigerant recovery device (not shown) may be connected to valve 74 and any refrigerant gas retained within chamber 64 may be recovered for later reprocessing or reuse by means of this device in the conventional manner.

The changes to the exterior of the compressor in accommodating the present invention are relatively minor and would entail the installation of chamber 64, at least one refrigerant gas detector 66, control valve 62, microcontroller 68, and wires 70, 72.

The size and shape of chamber 64 may be varied according to the type and the size of the compressor housing and/or system volume. It should be noted that as chamber 64 increases in volume, more refrigerant gas is captured in the event of a leak, thereby preventing a greater amount of refrigerant gas from escaping to the ambient environment and providing a greater amount for recovery. It is also notable that chamber 64 will fill at a faster rate when chamber 64 is attached to a high-side type of compressor since the housing portion to which chamber 64 is attached is at discharge, rather than suction, pressure. As such, a greater pressure differential is present between the interior of compressor housing 24 and evacuation volume 60.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A refrigeration system comprising:

a pair of heat exchangers;

a hermetic compressor assembly having a compressor housing containing refrigerant fluid;

fluid conveying lines; and a flow restriction device;

said heat exchangers, said compressor assembly, said lines, and said flow restriction device forming a working refrigerant system;

an evacuation volume having one of a first, substantially evacuated state and a second, fluid-containing state;

a control valve located between said working refrigeration system and said evacuation volume, said control valve having an initial, closed position and an open position, said evacuation volume being fluidly isolated from said working refrigeration system in said valve closed position and in fluid communication with said working refrigeration system in said valve open position; and at least one refrigerant gas detector located externally of said working refrigeration system and in communication with said control valve, said valve being opened in response to refrigerant gas being detected by said detector, whereby refrigerant fluid in said working refrigeration system is sucked into said evacuation volume and said evacuation volume undergoes a change from its first to its second state, said valve resuming its said closed position when said evacuation volume is in its said second state.

2. The refrigeration system of claim 1, wherein said evacuation volume is in communication with said compressor housing.

3. The refrigeration system of claim 1, wherein said evacuation volume is connected to said compressor housing.

4. The refrigeration system of claim 2, wherein said valve is moved from its said open to its said closed position in response to the pressures of fluid in said compressor housing and said evacuation volume being substantially equal.

5. The refrigeration system of claim 4, wherein a microcontroller moves said valve from its said open to its said closed position.

6. The refrigeration system of claim 1, wherein said valve is moved from its said open to its said closed position in response to said valve having been in its said open position for a predetermined period of time.

7. The refrigeration system of claim 6, wherein a microcontroller moves said valve from said open position to said closed position.

8. The refrigeration system of claim 1, wherein said evacuation volume is provided with a fitting through which fluid contained within said evacuation volume may be recovered from said evacuation volume when said valve is closed.

9. A refrigeration system comprising:

a working refrigeration system comprising:

a hermetic compressor assembly having a compressor housing containing refrigerant fluid;

a pair of heat exchangers;

a flow restriction device; and fluid conveying lines, in series connection;

an evacuation volume located externally of said compressor housing and having one of a first, substantially evacuated state and a second, fluid-containing state;

a control valve located between said working refrigeration system and said evacuation volume, said control valve having an open position and a closed position, said evacuation volume being fluidly isolated from said working refrigeration system in said valve closed position and in fluid communication with said working refrigeration system in said valve open position; and means for detecting a refrigerant leak external to said working refrigeration system, opening said valve in response to detection of a refrigerant leak and subsequently closing said valve to maintain said evacuation volume in its said second state and fluidly isolated from said working refrigeration system.

10. The refrigeration system of claim 9, wherein said evacuation volume is in communication with said compressor housing.

11. The refrigeration system of claim 9, wherein said evacuation volume is connected to said compressor housing.

12. The refrigeration system of claim 9, wherein said evacuation volume is in its said first state when said valve is opened.

13. The refrigeration system of claim 9, wherein said means comprises at least one refrigerant gas detector.

14. The refrigeration system of claim 10, wherein said valve is moved from its said open to its said closed position in response to the pressures of fluid in said compressor housing and said evacuation volume being substantially equal.

15. The refrigeration system of claim 14, wherein a microcontroller moves said valve from said open position to said closed position.

16. The refrigeration system of claim 9, wherein said valve is moved from its said open to its said closed position in response to said valve having been in its said open position for a predetermined period of time.

17. The refrigeration system of claim 16, wherein a microcontroller moves said valve from said open position to said closed position.

18. The refrigeration system of claim 9, wherein said evacuation volume is provided with a fitting through which fluid contained within said evacuation volume may be recovered from said evacuation volume.

19. A method of retaining at least a portion of refrigerant fluid of a refrigeration system in the event of a refrigeration leak therefrom, comprising:

detecting a refrigerant leak from the system at a location external to the system;

opening a valve located between the housing and an initially empty evacuation chamber in response to detection of the leak;

receiving at least a portion of the refrigerant fluid in the compressor housing through the open valve and into the evacuation chamber; and closing the valve after the evacuation chamber has received refrigerant fluid from the compressor housing.

20. The method of claim 19, further comprising:

recovering refrigerant fluid received within the evacuation when the valve is closed.

21. The method of claim 19, wherein closing the valve occurs after a predetermined period of time from the opening of the valve has elapsed.

22. The method of claim 21, wherein closing the valve is accomplished by a microcontroller.

23. The method of claim 19, wherein closing the valve occurs when the pressures of refrigerant fluid in the compressor housing and the evacuation chamber become substantially equal.

24. The method of claim 19, wherein closing the valve occurs when a microcontroller determines the pressures of refrigerant fluid become substantially equal.

25. The method of claim 24, wherein the microcontroller monitors the pressures of refrigerant fluid.

26. A hermetic compressor assembly comprising:

a compressor housing containing refrigerant fluid;

a compressor mechanism located in said housing;

a motor assembly located in said housing and operatively coupled to said compressor mechanism;

an evacuation volume attached to said compressor housing, said evacuation volume located externally of said compressor housing and having one of a first, substantially evacuated state and a second, fluid-containing state;

a control valve located between said compressor housing and said evacuation volume, said control valve having an open position and a closed position, said evacuation volume being fluidly isolated from said compressor housing in said valve closed position and in fluid communication with said compressor housing in said valve open position;

at least one refrigerant gas detector located externally of said compressor housing and in communication with said control valve, said valve being opened in response to refrigerant gas being detected by said detector whereby refrigerant fluid in said compressor housing is sucked into said evacuation volume and said evacuation volume undergoes a change from its first to its second state; and wherein said valve is in its said closed position when said evacuation volume is in its said second state.

27. The hermetic compressor assembly of claim 26, wherein said valve is moved from its said open to its said closed position in response to the pressures of fluid in said compressor housing and said evacuation volume being substantially equal.

28. The hermetic compressor assembly of claim 27, wherein a microcontroller moves said valve from said open position to said closed position.

29. The hermetic compressor assembly of claim 26, wherein said valve is moved from its said open to its said closed position in response to said valve having been in its said open position for a predetermined period of time.

30. The hermetic compressor assembly of claim 29, wherein a microcontroller moves said valve from said open position to said closed position.

31. The hermetic compressor assembly of claim 26, wherein said evacuation volume is provided with a fitting through which fluid contained within said evacuation volume may be recovered from said evacuation volume.

* * * * *

UNITED STATES PATENT AND TRADEMARK OFFICE

CERTIFICATE OF CORRECTION

PATENT NO. : 6,571,565 B2
DATED : June 3, 2003
INVENTOR(S) : Todd W. Herrick

It is certified that error appears in the above-identified patent and that said Letters Patent is hereby corrected as shown below:

Column 7,
Line 48, insert -- having a compressor housing-after "system"
Line 49, delete "therefrom" and substitute therefor -- from the system --

Signed and Sealed this

Twenty-first Day of October, 2003

JAMES E. ROGAN
*Director of the United States Patent and Trademark Office*